US008126340B2

(12) United States Patent
Bito et al.

(10) Patent No.: US 8,126,340 B2
(45) Date of Patent: Feb. 28, 2012

(54) DEVELOPER RECOVERING DEVICE AND IMAGE FORMING APPARATUS HAVING THE SAME

(75) Inventors: Takahiro Bito, Nara (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 908 days.

(21) Appl. No.: 11/902,696

(22) Filed: Sep. 25, 2007

(65) Prior Publication Data

US 2008/0075483 A1 Mar. 27, 2008

(30) Foreign Application Priority Data

Sep. 25, 2006 (JP) ..... 2006-259775

(51) Int. Cl.
*G03G 21/12* (2006.01)

(52) U.S. Cl. ..... 399/35; 399/99; 399/120; 399/358; 399/359; 399/360; 430/119.87; 430/119.88

(58) Field of Classification Search ..... 399/35, 399/99, 120, 359–360; 430/119.87–119.88
See application file for complete search history.

(56) References Cited

U.S. PATENT DOCUMENTS 3,838,922 A * 10/1974 Nelson ..... 399/35
4,724,459 A * 2/1988 Ford ..... 399/344
5,204,699 A * 4/1993 Birnbaum et al. ..... 347/131
5,260,747 A * 11/1993 Uwagawa et al. ..... 399/257
5,272,510 A * 12/1993 Reese et al. ..... 399/358
5,400,127 A * 3/1995 Arai et al. ..... 399/71
5,521,690 A * 5/1996 Taffler et al. ..... 399/93
5,585,899 A * 12/1996 Palumbo et al. ..... 399/62
5,589,915 A * 12/1996 Hashimoto ..... 399/120
5,805,953 A * 9/1998 Kikuchi et al. ..... 399/43
5,842,090 A * 11/1998 Mikawa ..... 399/256
5,918,085 A * 6/1999 Rollins et al. ..... 399/27
5,950,062 A * 9/1999 Yahata et al. ..... 399/358
6,104,892 A * 8/2000 Kobayashi et al. ..... 399/63
6,112,046 A * 8/2000 Suzuki et al. ..... 399/359
6,167,211 A * 12/2000 Oogi et al. ..... 399/53
RE37,542 E * 2/2002 Ichikawa et al. ..... 399/263
6,711,374 B2 * 3/2004 Funayama et al. ..... 399/359

(Continued)

FOREIGN PATENT DOCUMENTS

JP 57122472 A * 7/1982

(Continued)

OTHER PUBLICATIONS

English translation of Hirota et al. (JP pub 11-119622); published Apr. 30, 1999.*

(Continued)

*Primary Examiner* — David Gray
*Assistant Examiner* — Geoffrey Evans
(74) *Attorney, Agent, or Firm* — Nixon & Vanderhye

(57) ABSTRACT

The toner transporting section is provided with a plurality of toner discharge portions, selectively discharges a waste toner from any one of the plurality of toner discharge portions, and stores the waste toner in a waste toner container to which the waste toner discharged from the selected toner discharge portion is to be stored. Accordingly, it is possible to exchange the waste toner container corresponding to the toner discharge portion not used for discharging the waste toner. Therefore, it is possible to exchange the waste toner containers without stopping an image forming operation in an image forming apparatus provided with a cleaning device.

17 Claims, 7 Drawing Sheets

U.S. PATENT DOCUMENTS

| | | | | |
|---|---|---|---|---|
| 6,795,668 | B1 * | 9/2004 | Nishiwaki | 399/120 |
| 7,085,507 | B2 * | 8/2006 | Cook et al. | 399/35 |
| 7,120,366 | B2 | 10/2006 | Onodera et al. | |
| 7,127,207 | B2 * | 10/2006 | Tsurusaki | 399/359 |
| 7,280,796 | B2 * | 10/2007 | Isokawa et al. | 399/358 |
| 7,366,458 | B2 * | 4/2008 | Ishikawa et al. | 399/359 |
| 7,373,092 | B2 * | 5/2008 | Tawada | 399/35 |
| 7,526,217 | B2 * | 4/2009 | Takiguchi et al. | 399/35 |
| 7,555,246 | B2 * | 6/2009 | Zirilli | 399/253 |
| 7,920,816 | B2 * | 4/2011 | Ishikawa et al. | 399/358 |
| 7,965,972 | B2 * | 6/2011 | Ichikawa et al. | 399/358 |
| 8,023,839 | B2 * | 9/2011 | Sakatani et al. | 399/30 |
| 2004/0161272 | A1 * | 8/2004 | Park et al. | 399/358 |
| 2005/0002708 | A1 * | 1/2005 | Jeong et al. | 399/358 |
| 2005/0169649 | A1 * | 8/2005 | Onodera et al. | 399/35 |
| 2006/0002750 | A1 * | 1/2006 | Ono | 399/359 |
| 2006/0018691 | A1 * | 1/2006 | Baek et al. | 399/358 |
| 2006/0216066 | A1 * | 9/2006 | Kubota et al. | 399/257 |
| 2007/0009288 | A1 * | 1/2007 | Seo et al. | 399/258 |
| 2007/0104500 | A1 * | 5/2007 | Nagata | 399/45 |
| 2010/0080578 | A1 * | 4/2010 | Ichikawa | 399/34 |
| 2010/0080580 | A1 * | 4/2010 | Yamaguchi et al. | 399/35 |
| 2010/0080637 | A1 * | 4/2010 | Yamaguchi et al. | 399/358 |
| 2010/0080638 | A1 * | 4/2010 | Ichikawa et al. | 399/358 |
| 2010/0166441 | A1 * | 7/2010 | Kobayashi | 399/35 |
| 2010/0239341 | A1 * | 9/2010 | Tanaka et al. | 399/360 |
| 2010/0247192 | A1 * | 9/2010 | Ishikawa et al. | 399/358 |

FOREIGN PATENT DOCUMENTS

| | | | |
|---|---|---|---|
| JP | 05289584 | A | * 11/1993 |
| JP | 11-119610 | A | 4/1999 |
| JP | 11-119622 | A | 4/1999 |
| JP | 2002-189392 | A | 7/2002 |
| JP | 2003-271023 | A | 9/2003 |
| JP | 2004-21134 | A | 1/2004 |
| JP | 2004-101592 | A | 4/2004 |
| JP | 2004-151238 | A | 5/2004 |
| JP | 2005-242274 | A | 9/2005 |

OTHER PUBLICATIONS

English translation of Arai et al. (JP 05-289584).*

English translation of Kato (JP 57-122472).*

* cited by examiner

DEVELOPER RECOVERING DEVICE AND IMAGE FORMING APPARATUS HAVING THE SAME

CROSS-REFERENCE TO RELATED APPLICATION

This application claims priority to Japanese Patent Application No. JP 2006-259775, which was filed on Sep. 25, 2006, the contents of which are incorporated herein by reference in its entirety.

BACKGROUND OF THE INVENTION

1. Field of the Invention

The present invention relates to a developer recovering device which is provided in an electrophotographic image forming apparatus, for recovering a waste developer, as well as an image forming apparatus having the same.

2. Description of the Related Art

In image forming apparatuses utilizing an electrophotographic process, such as copying machines, printers, and the like, a toner image formed on an image bearing member is transferred onto a recording material, and then fixed onto the recording material by a fixing device. After the toner image has been transferred onto the recording material, a residual toner on the image bearing member is removed from the image bearing member as a waste toner by a cleaning device, and the waste toner is transported to waste toner containers. When the waste toner containers are filled with the waste toner to capacity, the waste toner containers are exchanged.

In a technique disclosed in Japanese Unexamined Patent Publication JP-A 2004-101592, in the electrophotographic image forming apparatus described above, among the waste toner containers corresponding to the plurality of image bearing members, respectively, a volume of the waste toner container corresponding to a black toner is larger than volumes of the waste toner containers corresponding to the other color toners.

In a technique disclosed in Japanese Unexamined Patent Publication JP-A 2005-242274, in the electrophotographic image forming apparatus described above, among the waste toner containers corresponding to the plurality of image bearing members, respectively, a volume of the waste toner container corresponding to an image bearing member situated on a downstream side of a transporting direction of a transferred medium is larger than a volume of the waste toner container corresponding to the image bearing member situated on an upstream side of a transporting direction of the transferred medium.

In a technique disclosed in Japanese Unexamined Patent Publication JP-A 2004-21134, in the electrophotographic image forming apparatus described above, by providing a buffer portion for temporarily storing the waste toner, a plurality of images are continuously formed without overflowing of the waste toner even after the waste toner containers have been filled to capacity.

In the techniques disclosed in JP-A 2004-101592 and JP-A 2005-242274, when any of the waste toner containers is filled with the waste toner to capacity, it is necessary to stop an image forming operation in the image forming apparatus in order to exchange the waste toner container.

Moreover, in the technique disclosed in JP-A 2004-21134, by temporarily storing the waste toner in the buffer portion, it is possible to exchange the waste toner container which has been filled to capacity, without stopping the image forming operation in the image forming apparatus. However, the waste toner left for a certain period is solidified compared with the waste toner which has been immediately cleaned. Therefore, the waste toner has a tendency to be jammed in a transporting path and the buffer portion. As a result, when the waste toner is transported using a screw, an undesired force may be possibly applied to the screw and a gear provided to rotate the screw, resulting in a breakdown of the screw and the gear.

SUMMARY OF THE INVENTION

An object of the invention is to provide a developer recovering device capable of exchanging waste toner containers without stopping an image forming operation in an image forming apparatus, and of smoothly recovering the waste toner, as well as an image forming apparatus having the same.

The invention provides a developer recovering device for transporting to waste developer containers a waste developer which has been recovered by a cleaning device for removing a residual developer on an image bearing member after a developer image has been transferred onto a recording material, comprising:

a developer transporting section having a plurality of developer discharge portions, for transporting the waste developer from the cleaning device so as to be selectively discharged from any one of the developer discharge portions;

a developer detecting section individually corresponding to the plurality of developer discharge portions, for detecting a storing state of the waste developer in the waste developer containers to which the waste developer discharged from the developer discharge portion is to be stored; and a control section for controlling the developer transporting section so as to discharge the waste developer from the developer discharge portion corresponding to a waste developer container of the waste developer containers, which is available for storing the waste developer, based on a detection result of the developer detecting section.

According to the invention, the plurality of developer discharge portions are provided in the developer transporting section, and the developer transporting section selectively discharges the waste developer from any one of the plurality of developer discharge portions, and the developer is stored in the waste developer container to which the waste developer discharged from the selected developer discharge portion is to be stored. Accordingly, it is possible to exchange the waste developer container corresponding to the developer discharge portion which is not used for discharging the waste developer. Therefore, the waste developer containers are exchanged without stopping an image forming operation in the image forming apparatus which is provided with the cleaning device. Moreover, the waste developer is discharged from any of the plurality of developer discharge portions to the waste developer containers without temporarily storing the waste developer while transporting the waste developer to the waste developer containers. Accordingly, it is possible to prevent the waste developer from being solidified and thereby producing a jam during its transportation, allowing a smooth recovering of the waste developer. Therefore, convenience is improved.

Furthermore, even when the waste developer container is provided corresponding to each of the plurality of developer discharge portions, the control section controls the developer transporting section to discharge the waste developer from the developer discharge portion corresponding to one of the waste developer containers, which is available for storing the waste developer, based on a storing state of the waste developer which is detected by the developer detecting section, thereby preventing the waste developer from being further discharged to the waste developer container which is not available for storing the waste developer, for example, when the waste developer containers are filled to capacity.

Further, in the invention, it is preferable that, in a case in which the plurality of developer containers capable of storing the waste developer are provided, when the control section allows a discharge of the waste developer from the developer discharge portion corresponding to one of the waste developer containers which is available for storing the waste developer, and determines that the waste developer containers have been filled to capacity, based on a detection result of the developer detecting section, the developer transporting section is controlled so as to discharge the waste developer from the developer discharge portion corresponding to the remaining one of the plurality of waste developer containers.

According to the invention, when the plurality of developer containers capable of storing the waste developer are provided, the control section allows a discharge of the waste developer from the developer discharge portion corresponding to one of the waste developer containers which is available for storing the waste developer, based on a detection result of the developer detecting section. When the control section determines that the waste developer container to which the waste developer is discharged has been filled to capacity, the developer transporting section is controlled so as to discharge the waste developer from the developer discharge portion corresponding to the remaining one of the plurality of waste developer containers. Accordingly, when the one waste developer container is filled with the waste developer to capacity, the developer transporting section discharges the waste developer by switching the waste developer discharge portion so as to discharge the waste developer to the waste developer container which is available for storing the waste developer. Accordingly, even though the one waste developer container is filled to capacity, the waste developer is transported to the waste developer container which is available for storing the waste developer, for example, the empty waste developer container. Therefore, even though the one waste developer container is filled to capacity, it is not necessary to stop an image forming operation in the image forming apparatus which is provided with the cleaning device, allowing the image forming operation in the image forming apparatus to continue.

Further, in the invention, it is preferable that the developer recovering device further comprises a display section, wherein the control section allows the display section to display predetermined alarm information, when it is determined that the at least one waste developer container has been filled to capacity, based on a detection result of the developer detecting section.

According to the invention, when the control section determines that the at least one waste developer container has been filled to capacity, based on a detection result of the developer detecting section, the control section allows the display section to display the predetermined alarm information, thereby encouraging a user to exchange the waste developer container, and to smoothly operate the developer recovering device.

Further, in the invention, it is preferable that the developer recovering device further comprises a container detecting section for detecting presence or absence of the available waste developer container in which the waste developer discharged from the respective developer discharge portions is to be stored, wherein the control section controls the developer transporting section so as to discharge the developer only from the developer discharge portion which is available for discharging the waste developer to the waste developer container, based on a detection result of the container detecting section.

According to the invention, based on a result obtained by using the container detecting section and detecting presence or absence of the available waste developer container in which the waste developer discharged from the respective developer discharge portions is to be stored, the control section controls the developer transporting section so as to discharge the developer only from the developer discharge portion which is available for discharging the waste developer to the waste developer container. Accordingly, it is possible to prevent the waste developer from being discharged from the developer discharge portion in which the corresponding waste developer container is not provided.

Further, in the invention, it is preferable that the developer transporting section includes a transporting path forming body which forms a transporting path, and is provided with openings individually communicating with the plurality of developer discharge portions; a shutter member in which the openings are provided in the transporting path forming body in an openable and closable manner; and an open-close driving section for moving the shutter member to open or close the openings.

According to the invention, the shutter member is moved by the open-close driving section to open or close the openings of the transporting path forming body provided with the openings individually communicating with the plurality of developer discharge portions. Accordingly, the waste developer is selectively discharged from any one of the developer discharge portions. When the shutter member for opening or closing the opening communicating with one of the developer discharge portion is kept opened, the shutter member for opening or closing the opening communicating with the remaining developer discharge portion is kept closed. Therefore, when the shutter member is kept closed, the waste developer containers are exchanged, thereby preventing the waste developer from being undesirably discharged, and preventing contamination by the waste developer in the image forming apparatus which is provided with the developer recovering device.

Further, in the invention, it is preferable that the developer transporting section includes an agitating portion for agitating the waste developer.

According to the invention, the developer transporting section includes the agitating portion for agitating the waste developer to agitate the waste developer having a tendency to be solidified. Accordingly, it is possible to prevent the waste developer from being solidified, and to certainly prevent the waste developer from being solidified and producing a jam during its transportation. Therefore, it is possible to smoothly recover the waste developer, preventing occurrence of a device failure caused by solidification of the waste developer to produce high reliability.

Further, in the invention, it is preferable that the agitating portion includes an agitating tank, and an agitating member for agitating the waste developer which is stored in the agitating tank, and rotates in contact with an internal wall of the agitating tank to be transported to the agitating tank, wherein in the agitating portion a portion in contact with the internal wall is formed using a member having flexibility and elasticity.

According to the invention, the waste developer which has been transported to the agitating tank is agitated while the agitating member is rotating. In the agitating member, a portion in contact with the internal wall surface is formed using a member having flexibility and elasticity, and when the agitating member rotates, the member having flexibility and elasticity slides in contact with the internal wall surface. Accordingly, the waste developer is prevented from being firmly fixed to a portion in contact with the member having flexibility and elasticity in the internal wall surface. Moreover, even though the waste developer may be fixed to this portion, deformation of the member prevents rotation of the agitating member from being hampered by the waste developer fixed to the agitating member, and thus prevents a failure of the agitating portion, thereby achieving a stable agitation by the agitating portion.

Further, the invention provides an image forming apparatus comprising:

an image forming section including an image bearing member for bearing a developer image and a cleaning section for removing a residual developer on the image bearing member, for allowing the image bearing section to bear the developer image based on image information, transferring the developer image onto a recording material, and fixing the transferred developer image onto the recording material; and the developer recovering apparatus mentioned above for recovering the developer which has been removed by the cleaning member.

According to the invention, by providing the above-described developer recovering device in the electrophotographic image forming apparatus, the waste developer containers are exchanged without stopping an image forming operation in the image forming section, preventing an image forming operation in the image forming section from being hampered by a developer recovering device to realize the image forming apparatus with which convenience is improved.

Further, in the invention, it is preferable that when the control section determines that all of the waste developer containers which are available for having the developer transported by the developer transporting section have been filled to capacity, based on a detection result of the developer detecting section, the control section allows the image forming section to stop an image forming operation.

According to the invention, when the waste developer containers have been filled to capacity, an image forming operation by the image forming section is stopped, thereby preventing the waste developer from being accumulated up to the developer transporting section, and preventing a failure of the waste developer recovering device.

Further, in the invention, the developer detecting section detects an amount of the developer which is stored in the waste developer containers, based on the image information.

According to the invention, the amount of the developer which is stored in the waste developer containers is detected based on the image information, and thereby it is not necessary to provide a sensor for measuring the amount of the waste developer in the waste developer containers, allowing a simple configuration of the apparatus. Moreover, the amount of the developer which is stored in the waste developer containers is continuously detected, allowing fine detection of a storing state of the waste developer in the waste developer containers. Accordingly, a printable sheet number to be printed until the waste developer containers are filled to capacity is obtained. Therefore, the apparatus has an advantage to allow a configuration that, for example, when a print is determined to be difficult by determining whether it is possible to print until a last page when a print request is received, an alarm is given to a user.

Further, in the invention, it is preferable that the image forming apparatus further comprises a locking section capable of individually engaging and locking the waste developer containers at a position capable of storing the waste developer discharged from the respective developer discharge portions, wherein the locking section locks the available waste developer container to which the waste developer is to be transported by the developer transporting section during an image forming operation by the image forming section, and unlocks the lock of the waste developer container to which the waste developer is not transported.

According to the invention, the locking section locks the available waste developer container to which the waste developer is transported by the developer transporting section during an image forming operation by the image forming section, and unlocks the lock of the waste developer container to which the waste developer is not transported. Accordingly, it is possible to prevent the waste developer container to which the developer transporting section discharges the waste developer from being undesirably removed. In addition, it is possible to remove and exchange the waste developer container to which the developer transporting section does not discharge the waste developer, even during an image forming operation by the image forming section.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
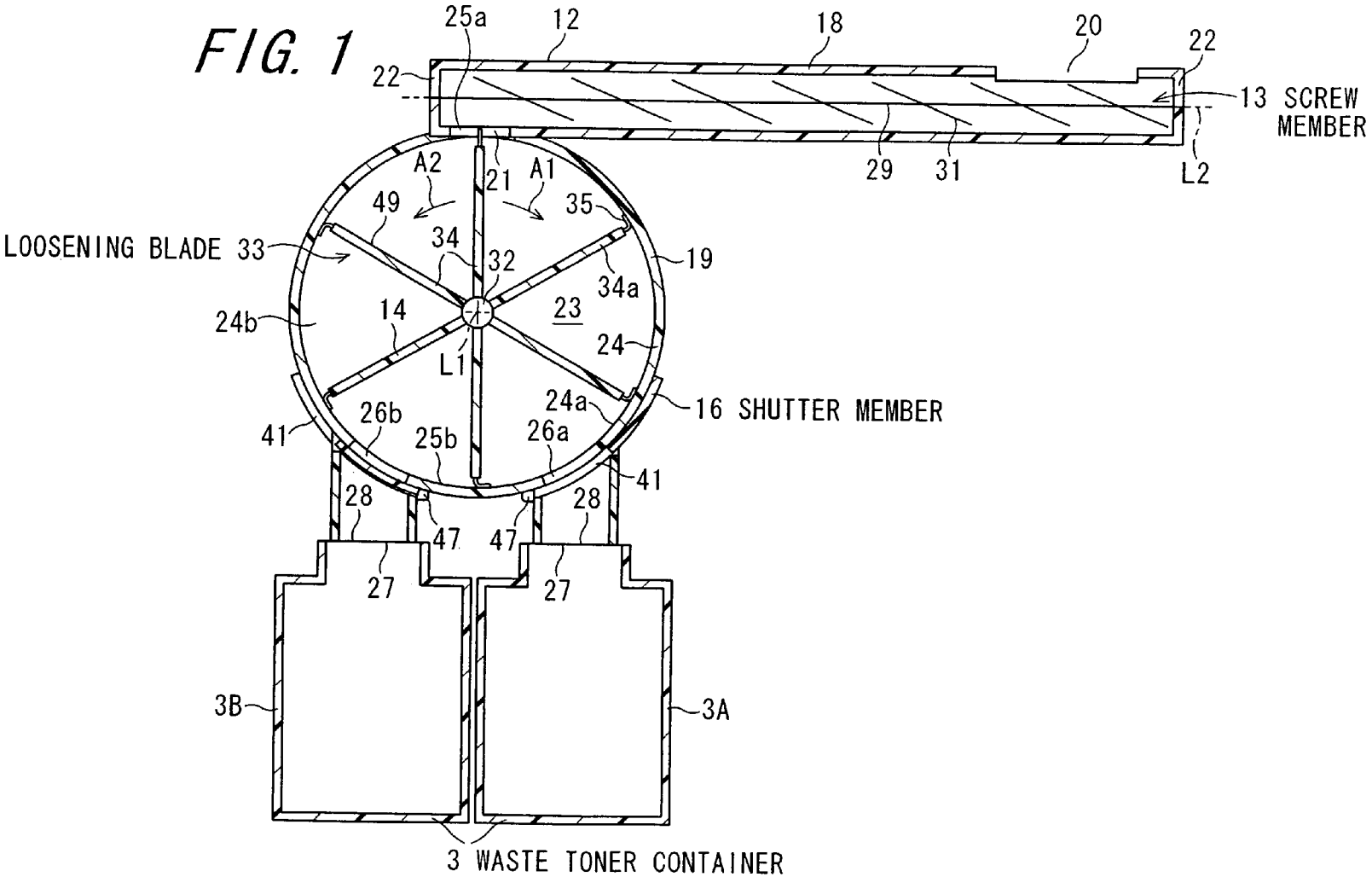
FIG. 1 is a schematic view illustrating a configuration of a toner recovering device according to one embodiment of the invention.

Now referring to the drawings, preferred embodiments of the invention are described below.

Figure 2:
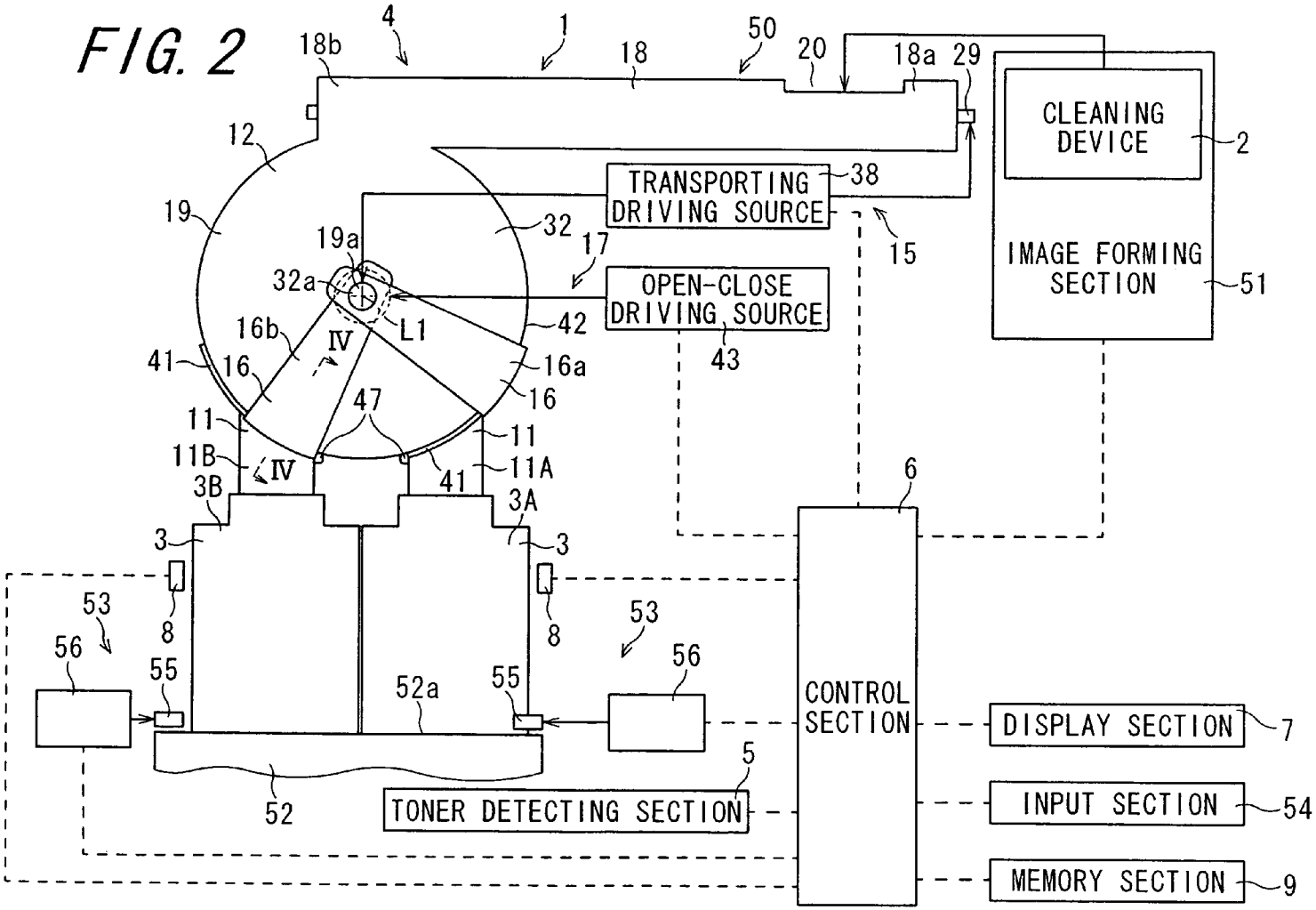
FIG. 2 is a cross-section view illustrating a part of a toner transporting section.

FIG. 1 is a schematic view illustrating a configuration of a toner recovering device 1 according to one embodiment of the invention. FIG. 2 is a cross-section view illustrating a part of a toner transporting section 4. In addition, FIG. 1 shows an image forming apparatus 50 which includes the toner recovering device 1. The toner recovering device 1 is provided in the electrophotographic image forming apparatus 50. The image forming apparatus 50 according to the embodiment is a printer.

The toner recovering device 1 transports to waste toner containers 3 a waste developer which has been recovered by a cleaning device 2 for removing a residual toner as a developer on an image bearing member after a developer image has been transferred onto a recording material. In the embodiment, the toner recovering device 1 does not include the waste toner containers 3, but may include the waste toner containers 3.

The toner recovering device 1 includes a toner transporting section 4, a toner detecting section 5, a control section 6, a display section 7, a container detecting section 8, and a memory section 9.

The toner transporting section 4 includes a plurality of toner discharge portions 11, and transports a waste toner from the cleaning device 2 so as to be selectively discharged from any one of the toner discharge portions 11. In the embodiment, the two toner discharge portions 11 are provided. When both are identified, they are referred to as a first toner discharge portion 11A and a second toner discharge portion 11B. When both are not identified, they are referred to as merely the toner discharge portion 11.

The toner detecting section 5 individually corresponds to the plurality of toner discharge portions 11, and detects a storing state of the waste toner in the waste toner container 3 to which the waste toner discharged from the toner discharge portion 11 is to be stored. The toner detecting section 5 is realized by a microcomputer, includes a central processing unit (a CPU), and a storage medium having a calculation program stored, and is realized by execution of a calculation program by the central processing unit. The toner detecting portion 5 detects an amount of the waste toner based on image data inputted from an input section 54 as described later. A volume of the waste toner container 3 is selected, for example, to around 100 $cm^3$ to 3,000 $cm^3$ according to a printing speed. In a case of a high-speed machine, it is preferably selected to around 2,000 $cm^3$ to 3,000 $cm^3$ in view of relaxation of an exchange frequency of the waste toner container, and a handling ability of the waste toner container.

The control section 6 controls the toner transporting section 4 based on a detection result of the toner detecting section 5 so that the waste toner is discharged from the toner discharge portion 11 corresponding to the waste toner container 3 which is available for storing the waste toner, that is, either of the first toner discharge portion 11A or the second toner discharge portion 11B. The control section 6 is realized, for example, by a microcomputer, includes a central processing unit, and a storage medium having a control program stored, and is realized by execution of the control program by the central processing unit.

In a case in which the plurality of waste toner containers 3 which are available for storing the waste toner are provided, when the control section 6 determines that the waste toner container 3 has been filled to capacity by allowing the waste toner to be discharged from the toner discharge portion 11 corresponding to one of the waste toner containers 3, based on a detection result of the toner detecting section 5, the control section 6 controls the toner transporting section 4 so that the waste toner is discharged from the toner discharge portion 11 corresponding to the remaining one of the plurality of waste toner containers 3.

The display section 7 includes at least either of a display device for displaying an image or an audio output device for displaying audio information. The display device is realized, for example, by a liquid crystal display device, and the audio output device is realized, for example, by a speaker.

The control section 6 allows the display section 7 to display predetermined alarm information, when determining that the at least one waste toner container 3 is filled to capacity, based on a detection result of the toner detecting section 5. The predetermined alarm information includes information for prompting to exchange the waste toner container 3 which has been filled to capacity. In the waste toner containers 3, one for storing the waste toner discharged from the first toner discharge portion 11A is referred to as a first waste toner container 3A, the other for storing the waste toner discharged from the second toner discharge portion 11B is referred to as a second waste toner container 3B. The predetermined alarm information includes, for example, character information, "Please exchange the waste toner container", and audio information, "Please exchange the waste container", which is emitted from a speaker. The alarm information is stored in the memory section 9.

The container detecting section 8 detects presence or absence of the waste toner container 3 to which the waste toner discharged from the respective toner discharge portions 11 is to be stored. The container detecting section 8 is realized by a photoelectronic sensor for emitting "light beams" such as a visible light beam, and an infrared light beam as a signal light beam from its flood lighting portion and receiving a light beam reflected by a detected object using a light-receiving portion (a reflection type), or the photoelectronic sensor for detecting a change in an amount of a light beam shielded by the detected object using a light-receiving sensor (a transmission type, or a recurrence reflection type). In another embodiment of the invention, the container detecting section 8 may be realized by a mechanical switch. In this case, a switching aspect of the mechanical switch may be changed, when the waste toner container 3 is arranged at a predetermined position capable of receiving the waste toner from the toner discharge portion 11, when the waste toner container 3 is arranged at a predetermined position not capable of receiving the waste toner from the toner discharge portion 11, or when the waste toner container 3 is not arranged.

The control section 6 controls the toner transporting section 4 so as to discharge the toner only from the toner discharge portion 11 which is available for discharging the waste toner to the waste toner container 3, based on a detection result of the container detecting section 8.

The memory section 9 includes a nonvolatile storage medium, and is realized by a flash ROM, or the like. The memory section 9 records alarm information, and records bottle information individually representing a state of each of the waste toner containers 3, according to an instruction from the control section 6. The bottle information represents whether the waste toner containers 3 are in use (a state capable of carrying out the waste toner) or not, they are filled to capacity or not, or they are empty or not. Moreover, the memory section 9 records total waste toner amount information representing an amount of the toner stored in the waste toner containers 3. The control section 6 controls the toner transporting section 4 so as to discharge the waste toner from the toner transporting section 4 to the waste toner container 3 represented by the bottle information recorded in the memory section.

The toner transporting section 4 includes a transporting path forming body 12, a screw member 13, a agitating member 14, a transporting driving section 15, a shutter member 16, and a open-close driving section 17, in addition to the above-described waste toner discharge portion 11.

The transporting path forming body 12 forms a transporting path of the waste toner from the cleaning device 2 to the waste toner discharge portion 11. The transporting path forming body 12 includes a toner transporting pipe 18 which is coupled to the cleaning device 2, and an agitating tank 19 which is connected to the toner transporting pipe 18. The toner transporting pipe 18 is formed in a cylindrical shape, and one end portion 18*a* thereof is connected to the cleaning device 2, and the other end portion 18*b* thereof is connected to the agitating tank 19. In the other end portion 18*b* of the toner transporting pipe 18, a discharge coupling hole 21 is formed in an outer peripheral portion in a radial direction with respect to an axis line of the toner transporting pipe 18, and in a portion facing a lower side. Further, a charging communicating hole 20 is formed in an intermediate portion between both end portions in an axial direction of the toner transporting pipe 18. The charging communicating hole 20 charges the waste toner from the cleaning device 2 into a space surrounded by the toner transporting pipe 18. A wall portion 22 is formed in both end portions in an axial direction of the toner transporting pipe 18, and the waste toner transported from a side of the one end portion 18*a* to a side of the other end portion 18*b* falls down to a lower side from the discharge coupling hole 21 at the other end portion 18*b* of the toner transporting pipe 18.

The agitating tank 19 is a container having an approximately cylindrical storing space 23, and an internal wall surfaces 24 facing the storing space 23 thereof includes a cylindrical surface portion 24*a* of the approximately cylindrical shape, and a side wall surface portion 24*b* which is provided on both end portions in an axial direction of a cylinder formed by the cylindrical surface portion 24*a*, and which is connected to the cylindrical surface portion 24*a*. An axis line L1 of the cylinder formed by the cylindrical surface portion 24*a* horizontally extends. In an upper end portion 25*a* of the agitating tank 19, an opening communicating with the discharge coupling hole 21 is formed on the cylindrical surface portion 24*a*. A volume of the storing space 23 is selected to, for example, around 1,000 $cm^3$ to 2,000 $cm^3$.

In a lower end portion 25*b* of the agitating tank 19, a plurality of openings 26 communicating between the storing space 23 and an outside space are formed on the cylindrical surface portion 24*a* at intervals in a circumferential direction of the cylindrical surface portion 24*a*. In the embodiment, the two openings 26 are formed, and are referred to as a first opening 26*a* and a second opening 26*b*, respectively, when both are identified.

The toner discharge portion 11 is formed in a cylindrical shape, and arranged on an external wall portion of the agitating tank 19 so that its inner peripheral surface extends in parallel to a vertical direction. The plurality of openings 26 described above are formed individually in communication with the plurality of toner discharge portions 11. That is, the openings 26 communicate with a space surrounded by the inner peripheral surface of the toner discharge portion 11. The first opening 26*a* communicates with a space surrounded by the inner peripheral surface of the toner discharge portion 11A, and the second opening 26*b* communicates with a space surrounded by the inner peripheral surface of the toner discharge portion 11B.

A falling hole 27 of a lower end portion of the toner discharge portion 11 is formed to have a shape similar to an opening 28 of the waste toner containers 3, and is formed slightly smaller than the opening 28 of the waste toner containers 3. Accordingly, the waste toner discharged from the toner discharge portion 11 is prevented from spilling over from the waste toner containers 3 provided at a predetermined position. In another embodiment of the invention, when the waste toner containers 3 are arranged at a predetermined position, the toner discharge portion 11 may be formed so that the lower end portion of the toner discharge portion 11 is slightly disposed into a storing space of the waste toner containers 3. In this case, the waste toner discharged from the toner discharge portion 11 is certainly prevented from spilling over from the waste toner containers 3 provided at a predetermined position. The lower end portion of the toner discharge portion 11 is disposed from the opening of the waste toner containers 3 into a lower side in a predetermined range, and the predetermined range is selected to a range of around 1 cm to 2 cm.

The screw member 13 is arranged in a transporting path which is formed by the toner transporting pipe 18, and transports the waste toner from a side of the one end portion 18*a*to a side of the other end portion 18*b* in the toner transporting pipe 18. The screw member 13 is formed by a rotary shaft portion 29 which extends in parallel to the toner transporting pipe 18, and a spiral portion 31 which is provided on an outer peripheral surface of the rotary shaft portion 29 in a spiral manner. The waste toner can be moved along the spiral portion 31 by rotating the screw member 13 around an axis line L2 of the rotary shaft portion 29. Both end portions in an axial direction of the rotary shaft portion 29 are supported by the wall portion 22 of the toner transporting pipe 18 so as to be rotatable, the other of both end portions is projected outward from the wall portion 22.

The agitating member 14 is arranged in the storing space 23 of the agitating tank 19. The agitating member 14 includes an agitating shaft portion 32 and a loosening blade 33 which is provided in an outer peripheral portion of the agitating shaft portion 32. The loosening blade 33 includes a plurality of plate members 34 and a contacting member 35 in contact with the agitating tank 19. The plate member 34 has a rectangular parallelepiped shape. The plurality of plate members 34 are arranged at predetermined intervals around an axis line of the agitating shaft portion 32. The axis line of the agitating shaft portion 32 is the above-described axis line L1. The plate member 34 is arranged in the agitating shaft portion 32 around the axis line L1 in a rotationally-symmetric manner. In the embodiment, the agitating shaft portion 32 is provided with the six plate members 34. A track through which a free end of the plate member 34 passes becomes a circle on a virtual plane perpendicular to the axis line L1, and a diameter of the circle is selected, for example, to a range of 80 mm to 200 mm. The agitating shaft portion 32 and the plate member 34 are integrally composed of a synthetic resin, for example, of plastic having a high hardness, such as an engineering plastic and a fiber-reinforced plastic.

A dimension of an axis line L1 direction of the agitating member 14 is formed slightly smaller than a distance between the side wall surface portions 24*b* in an axis line L1 direction. Accordingly, friction between the agitating member 14 and the side wall surface portion 24*b*, which increases contact resistance, is prevented to smoothly rotate the agitating member 14. Moreover, the openings 26 are formed throughout between the side wall surface portions 24*b* in an axis line L1 direction. Accordingly, the waste toner is prevented from retaining in the agitating tank 19.

Figure 3:
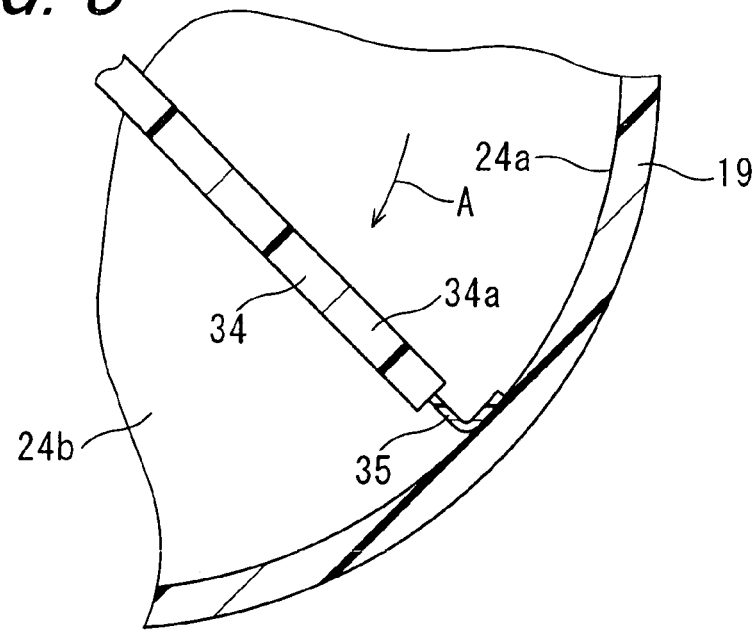
FIG. 3 is an enlarged cross-section view illustrating a part of an agitating member and a part of an agitating tank.

FIG. 3 is an enlarged cross-section view illustrating a part of the agitating member 14 and a part of the agitating tank 19. The agitating member 14 is provided in contact with a cylindrical surface portion 24*a*. A free end portion 34*a* of the plate member 34 of the agitating member 14 is separated at a certain distance from the cylindrical surface portion 24*a*. The free end portion 34*a* is provided with the contacting member 35 having flexibility and elasticity. The contacting member 35 is in contact with the cylindrical surface portion 24*a*. The contacting member 35 is a film-shaped member composed of a synthetic resin, or a plate member composed of a synthetic rubber. When the agitating member 14 is rotated around the axis line L1, the contacting member 35 is in sliding contact with the cylindrical surface portion 24*a*. Both end portions in an axial direction of the agitating shaft portion 32 are supported by the agitating tank 19 so as to be rotatable. One end portion 32*a* in an axial direction of the agitating shaft portion 32 is projected outward from the agitating tank 19. The waste toner which has been guided to the storing space 32 of the agitating tank 19 is transported and agitated by rotation of the agitating member 14.

The transporting driving section 15 includes a transporting driving source 38, and a transporting transmitting section for transmitting a driving force of the transporting driving source 38 to the agitating shaft portion 32 and the rotary shaft portion 29. The transporting driving source 38 is realized by a motor, and the transporting transmitting section is realized, for example, by a gear. A gear is fixed to the one end portion 32*a* in an axial direction of the agitating shaft portion 32, and a gear is fixed to one end portion in an axial direction of the rotary shaft portion 29. The agitating shaft portion 32 and the rotary shaft portion 29 can be rotated around respective axis lines thereof by driving the gears. There may be provided a configuration in which a rotating force of one motor is transmitted to the agitating shaft portion 32 and the rotary shaft portion 29 by the transporting transmitting section, or a configuration in which a rotating force from the individual motor is transmitted thereto by the individual transporting transmitting section. When a rotating force from the individual motor is transmitted by the individual transporting transmitting section to rotationally drive the agitating shaft portion 32 and the rotary shaft portion 29, each motor is controlled by the control section 6 so as to drive the agitating shaft portion 32 and the rotary shaft portion 29 in an interlocking fashion. An agitating portion includes the agitating tank 19, an agitating member 14, and the transporting driving section 15. The transporting driving section 15 rotationally drives the agitating shaft portion 32, for example, at one revolution every two seconds (0.5 rps).

Figure 4:
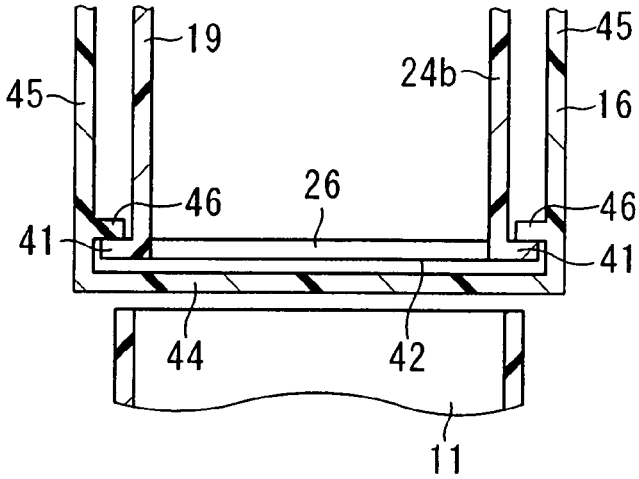
FIG. 4 is a cross-section view taken from line IV-IV of FIG. 2.

FIG. 4 is a cross-section view taken from line IV-IV of FIG. 2. The shutter member 16 is provided in the agitating tank 19, and is provided with the respective openings 26 so as to be openable or closable individually. A guide rail portion 41 for guiding the shutter member 16 is formed on an external surface portion of the agitating tank 19. The guide rail portion 41 is formed so as to project outward in the axis line L1 direction at both ends of the axis line L1 direction of the agitating tank 19. The guide rail 41 is formed along an outer peripheral surface 42 around the axis line L1 to have a circular shape. In the embodiment, the outer peripheral surface 42 has an approximately cylindrical shape. The shutter member 16 is arranged in a shiftable fashion from a closing position for closing the opening 26 to an opening position for opening the opening 26. The shutter member 16 provided so as to open or close a first opening 26*a* is referred to as a first shutter member 16*a*, and the shutter member 16 provided so as to open or close a second opening 26*b* is referred to as a second shutter member 16*b*, and when both are not identified, they are referred to as merely the shutter member 16.

The shutter member 16 includes a shutter body 44 which is formed along the outer peripheral surface 42 to have a circular shape, an arm portion 45 which is formed so as to extend from both end portions of the axis line L1 direction of the shutter body 44 to a region through which the axis line L1 passes, and a projecting portion 46 which is provided in the arm portion 45 and is formed so as to dispose the guide rail portion 41 between the arm portion 45 and the shutter body 44. The projecting portion 46 is formed along the guide rail portion 41 to have a circular shape.

The arm portion 45 is disposed into an axis member (not shown) which is coaxially provided with the axis line L1, and is supported so as to be rotatable around the axis line L1. The axis member is provided in the agitating tank 19.

The opening position and the closing position are selected so that when the shutter member 16 is arranged at the opening position, the shutter body 44 is situated on an upper side around the axis line L1 compared with when the shutter member 16 is arranged at the closing position. Accordingly, a force that tries to move toward a lower side by gravity, that is, in a direction toward the closing position acts on the shutter member 16. Therefore, it is possible to move the shutter member 16 to the closing position by gravity, preventing the waste toner from leaking, even though there is raised a failure that a driving force is not transmitted from the open-close driving section 17 described later to the shutter member 16.

The regulating member 47 for regulating displacement toward a lower side at the closing position is provided in the guide rail portion 41. Accordingly, the movement of the shutter member 16 can be certainly stopped at the closing position. A space of the arm portion 45 of the first shutter member 16*a* in the axis line L1 direction and a space of the arm portion 45 of the second shutter member 16*b* in the axis line L1 direction are formed so as to be different from each other, and the arm portions 45 are supported by a shaft member so as not to interfere with each other.

The open-close driving section 17 moves the shutter member 16 throughout between the closing position and the opening position. The open-close driving section 17 includes an open-close driving source 43, and an open-close transmitting section for transmitting a driving force of the open-close driving source 43 to the shutter member 16. The open-close driving source 43 is realized by a motor, and the open-close transmitting section is realized, for example, by a gear. The open-close driving source 43 and the open-close transmitting section corresponding to the first and second shutter members 16*a* and 16*b* are provided respectively, and the first and second shutter members 16*a* and 16*b* are individually openable or closable.

When the waste toner is discharged from the first opening 26*a*, the transporting driving section 15 rotates the agitating member 14 so that the waste toner discharged from the discharge coupling hole 21 passes through a region in which the first opening 26*a* is formed, before said waste toner passes through a region in which the second opening 26*b* is formed, that is, in a direction of an arrow A1 of FIG. 1. Moreover, when the waste toner is discharged from the second opening 26*b*, the transporting driving section 15 rotates the agitating member 14 so that the waste toner discharged from the discharge coupling hole 21 passes through a region in which the second opening 26*b* is formed, before said waste toner passes through a region in which the first opening 26*a* is formed, that is, in a direction of an arrow A2 of FIG. 1.

An image forming apparatus 50 includes the above-described toner recovering device 1, an image forming section 51, a mounting portion 52, a locking section 53, and an input section 54. The image forming section 51 includes an image bearing member for bearing a toner image, and the above-described cleaning device 2 for removing a residual toner on the image bearing member, allows the image bearing member to bear the toner image based on image information, and transfers the toner image onto a recording material to fix it onto the recording material.

The mounting portion 52 supports the waste toner containers 3 in a housing of the image forming apparatus 50. The mounting portion 52 includes a setting surface 52*a* for setting the waste toner containers 3. The waste toner containers 3 are set on the setting surface 52*a*. A positioning portion for positioning the waste toner containers 3 is formed on the setting surface 52*a*. The positioning portion is arranged so as to fit a recess formed on the waste toner containers 3, and thereby the waste toner containers 3 can be arranged at a predetermined position capable of storing the waste toner discharged from the respective openings 26.

The locking section 53 is provided so as to individually engage and lock the waste developer containers 3 which are arranged at a predetermined position on the mounting portion 52. The locking section 53 includes a locking piece 55; and a locking piece driving section 56 for displacing the locking piece 55 between a locking position for preventing the locking piece 55 from being removed from the mounting portion 52 of the waste toner containers 3 by making the locking piece 55 abut on the waste toner containers 3, and a locking releasing position capable of removing the locking piece 55 from the mounting portion 52 of the waste toner containers 3 by separating from the waste toner containers 3. The locking piece driving section 56 is realized by a motor.

Figure 5:
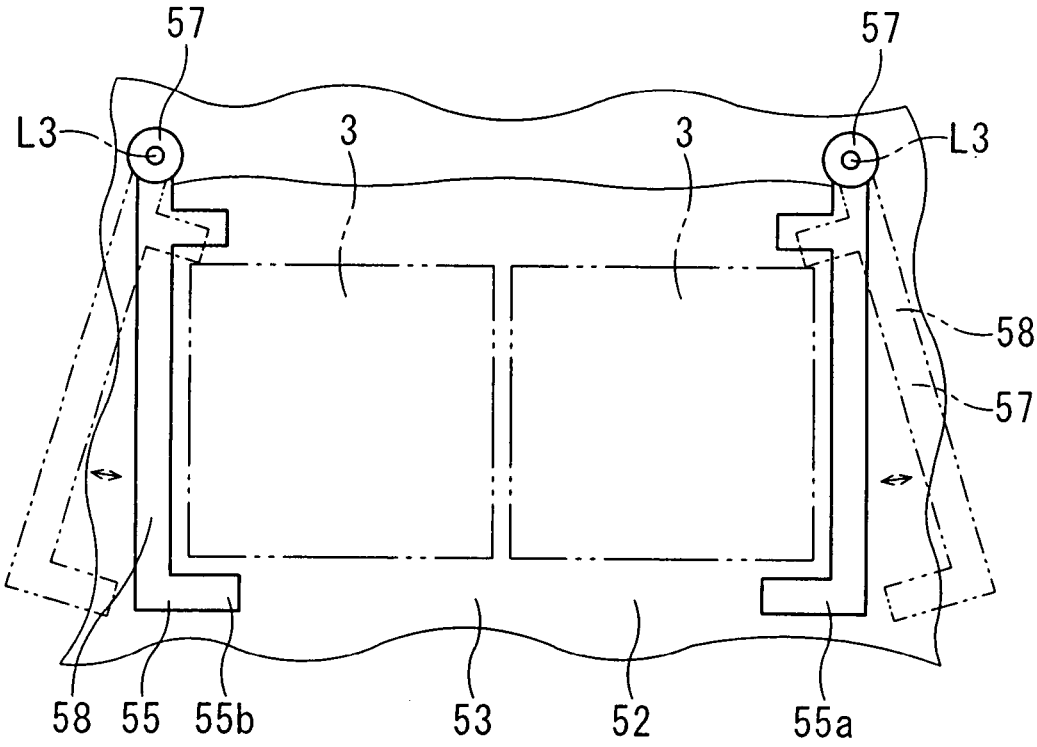
FIG. 5 is a view schematically illustrating a state in which a locking piece locks waste toner containers.

FIG. 5 is a view schematically illustrating a state in which the locking piece 55 locks the waste toner containers 3. One end portion 57 of the locking piece 55 is mounted on the mounting portion 52 so as to allow an angular displacement around an angular displacement axis line L3. The locking piece 55 is capable of shifting in parallel to the setting surface 52*a*. The waste toner containers 3 are formed to have an approximately rectangular parallelepiped shape. The locking piece 55 includes a contacting portion 58 whose cross-section perpendicular to the angular displacement axis line L3 has a U-shape. When the locking piece 55 is arranged at the locking position, the contacting portion 58 faces three side walls among four side walls of the waste toner container 3. The locking piece 55 capable of locking the first waste toner container 3A is referred to as a first locking piece 55*a*, and the locking piece 55 capable of locking the second waste toner container 3B is referred to as a second locking piece 55*b*, and when both are not identified, they are referred to as merely the locking piece 55.

The first waste toner container 3A and the second waste toner container 3B are arranged side-by-side so as to have one side wall facing each other. The first locking piece 55*a* is provided in the first waste toner container 3A on an opposite side of the second waste toner container 3B, and the second locking piece 55*b* is provided in the second waste toner container 3B on an opposite side of the first waste toner container 3A. That is, the first locking piece 55*a* is arranged so as to face a side wall of the first waste toner container 3A on an opposite side of the second waste toner container 3B, and a series of two side walls adjacent to this side wall, at the locking position. The second locking piece 55*b* is arranged so as to face a side wall of the second waste toner container 3B on an opposite side of the first waste toner container 3A, and a series of two side walls adjacent to this side wall, at the locking position.

Even though only either of the first waste toner container 3A or the second waste toner container 3B is set, it is possible to lock it by the locking piece 55, suppressing or preventing a careless removal of the waste toner container 3.

During an image forming operation by an image forming section 51, the locking section 53 is controlled by the control section 6 to lock the waste toner container 3 to which the waste toner is to be transported by the toner transporting section 4, or to release the lock of the waste toner container 3 to which the waste toner is not transported.

When the control section 6 determines that all of the waste developer containers 3 which is available for having the toner transported by the toner transporting section 4 are filled to capacity, based on a detection result of the developer detecting section 5, the control section 6 allows the image forming section 51 to stop an image forming operation. The waste tone is a toner which is obtained by using the cleaning device 2 and removing and recovering a residual toner attached on a photoreceptor after an image formed by the toner has been transferred. Therefore, a discharging amount of the waste toner at each pixel depends on an attaching amount of the toner, and is affected by a signal input value of peripheral pixels. Accordingly, an amount of the waste toner can be detected by calculation based on image data. For example, when a transfer efficiency is 90%, 10% of the toner used for development become the waste toner.

Figure 6:
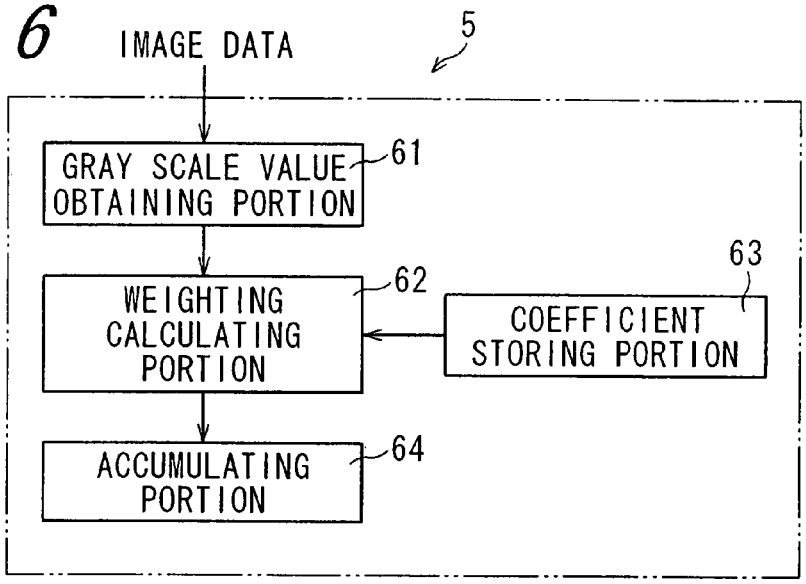
FIG. 6 is a block diagram illustrating a configuration of a toner detecting section.

FIG. 6 is a block diagram illustrating a configuration of the toner detecting section 5. The toner detecting section 5 carries out a pixel count, as described later, with respect to a multiple value image which is represented by an inputted image signal. The toner detecting section 5 includes a gray scale value obtaining portion 61, a weighting calculating portion 62, a coefficient storing portion 63, and an accumulating portion 64. The toner detecting section 5 is realized by a microcomputer.

The gray scale value obtaining portion 61 obtains a gray scale value of the inputted multiple value image with respect to each pixel. That is, it obtains the signal input value (the gray scale value) with respect to each pixel constituting the multiple value image, for example, the signal input value representing 0 to 15 in a case of a 16-gray scale in which the signal input value takes a value of 0 to 15.

The weighting calculating portion 62 weighs the gray scale value of each pixel which has been obtained by the gray scale value obtaining portion 61, with respect to each pixel. Specifically, the weighting calculating portion 62 obtains an estimated value of a discharging amount of the waste toner with respect to each pixel, by obtaining a weighting coefficient corresponding to the signal input value with respect to each pixel from a weighting coefficient table stored in the coefficient storing portion 63, and multiplying the signal input value by the obtained weighting value. The weighting coefficient value stored in the coefficient storing portion 63 includes the respective weighting coefficients corresponding to the plurality of signal input values. As described above, in the toner detecting section 5, the discharging amount of the waste toner is obtained by using the gray scale value obtaining portion 61, the weighting calculating portion 62, and the weighting coefficient table stored in the coefficient storing portion 63.

Further, the accumulating portion 64 accumulates the estimated value of the discharging amount of the waste toner with respect to all pixels. That is, the accumulating portion 64 accumulates the estimated value of the discharging amount of the waste toner which is obtained by using the weighting calculating portion 62 and multiplying the input signal value by the weighting coefficient, with respect to all pixels of the inputted multiple value image. Further, the accumulating portion 64 calculates the total discharging amount of the waste toner from when the waste toner container 3 has been exchanged to the new waste toner container 3 until now, based on the estimated value of the discharging mount of the waste toner.

The weighting coefficient in the weighting coefficient table stored in the coefficient storing portion 63 is predetermined according to the signal input value. Table 1 shows one example of the weighting coefficient table in a case of the signal input value having 16 values from 0 to 15.

TABLE 1

| | Input signal value | Weighting coefficient |
|---|---|---|
| Area 1 | 0 to 4 | 0 |
| Area 2 | 5 to 8 | 1 |
| Area 3 | 9 to 12 | 3 |
| Area 4 | 13 to 15 | 4 |

In Table 1, the 16 signal input values having the various discharging amounts of the waste toner are divided into four areas (Area 1 to Area 4), and the weighting coefficient is defined with respect to each area. When the weighting calculating portion 62 carries out the weighting, the weighting coefficients divided into four areas are selected corresponding to the respective signal input values taking a value of 0 to 15, and thereby the weighting is discharged. In Table 1, the weighting coefficient of the signal input value of 0 to 4 is "0", the weighting coefficient of the signal input value of 5 to 8 is "1", the weighting coefficient of the signal input value of 9 to 12 is "3", and the weighting coefficient of the signal input value of 13 to 15 is "4".

Figure 7:
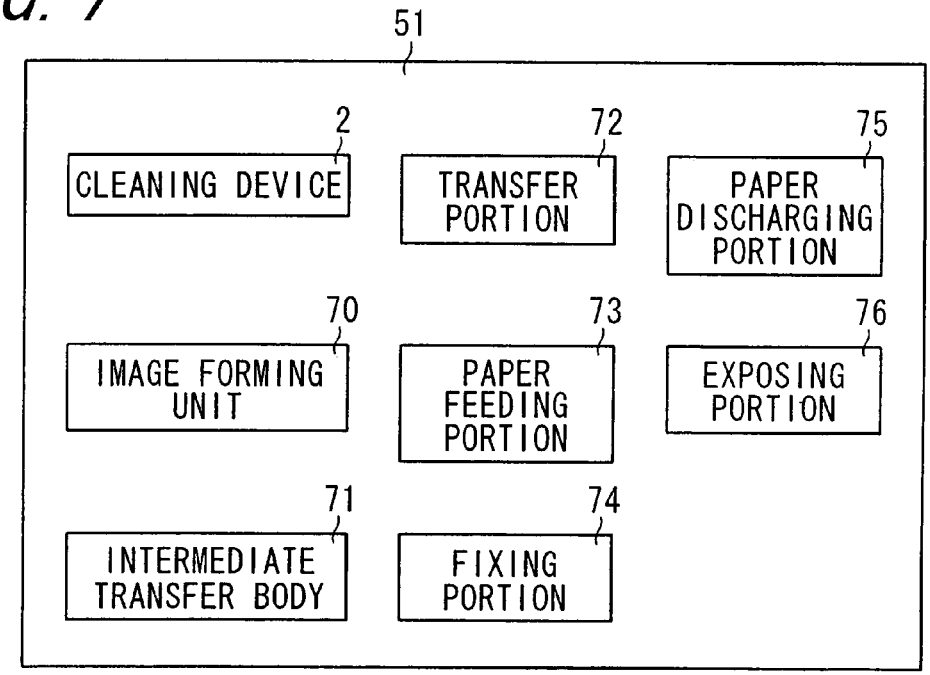
FIG. 7 is a block diagram illustrating a configuration of an image forming apparatus.

FIG. 7 is a block diagram illustrating a configuration of the image forming apparatus 50. The image forming apparatus 50 is a tandem-type image forming apparatus. The image forming section 51 includes the cleaning device 2, a plurality of image forming units 70 for forming a toner image, an intermediate transfer body 71, a transfer portion 72, a paper feeding portion 73 for feeding a recording sheet, a fixing portion 74, a paper discharging portion 75, a transporting system for transporting a recording sheet in a main body of an image forming apparatus 50, and an exposing portion 76. The cleaning device 2 is configured with photoreceptor cleaning devices which are provided corresponding to the image forming units 70 corresponding to cyan, magenta, yellow, and black, respectively, and a transfer body cleaning device.

A plurality of toner images which are formed on the photoreceptors included in the image forming units 70 are transferred and overlaid onto the intermediate transfer body 71, and the transfer portion 72 transfers the toner images which have been collectively transferred onto the intermediate transfer body 71 onto a recording sheet as a transferred medium (a recording material).

The photoreceptor cleaning device cleans a residual toner on the photoreceptor which is not transferred from the photoreceptor onto the intermediate transfer body 71. The transfer body cleaning device cleans a residual toner on the intermediate transfer body 71 which is not transferred from the intermediate transfer body 71 to a recording sheet. The toner recovering device 1 recovers the toner (the waste toner) which has been cleaned by the photoreceptor cleaning device and the transfer body cleaning device. The fixing portion 74 fixes the toner image which has been transferred on the recording sheet. The recording sheet on which the toner image is fixed is discharged to the paper discharging portion 75.

The image forming apparatus 50 is, for example, a digital color printer, and forms a full-color image or a monochromic image on a recording sheet, based on a print job transmitted from information processing devices such as personal computers.

Figure 8:
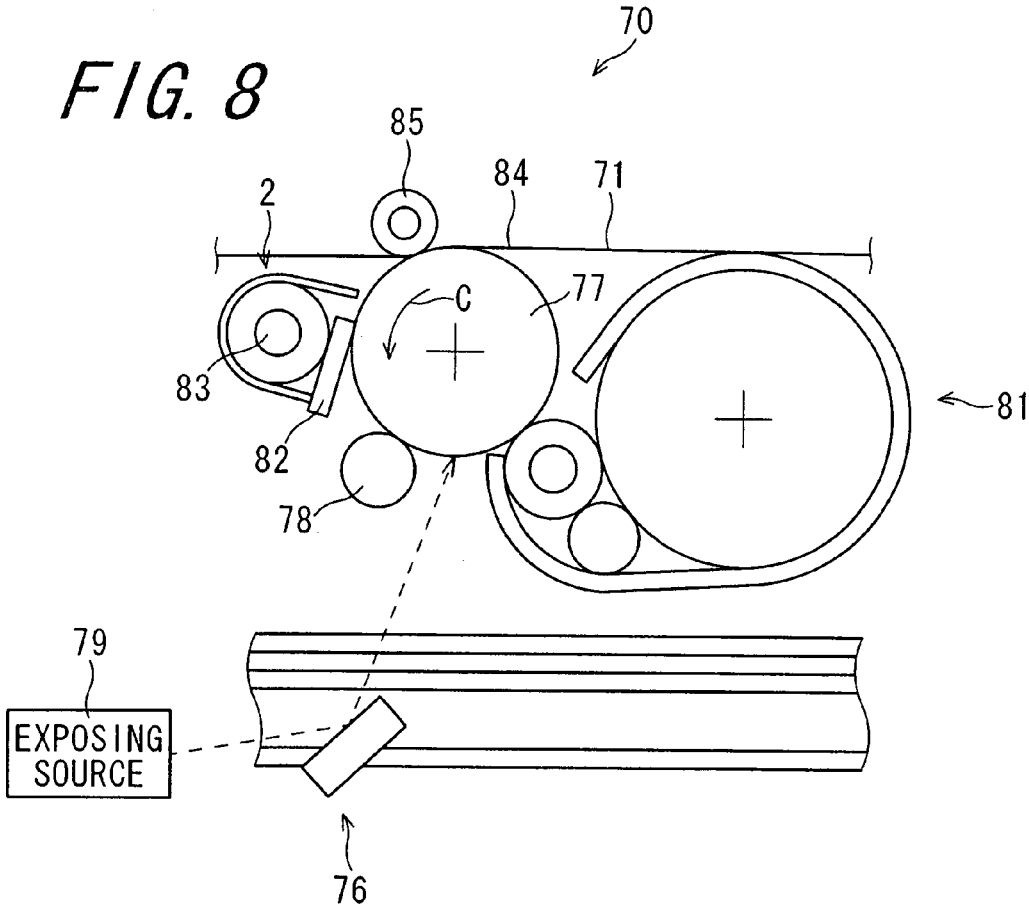
FIG. 8 is a schematic view illustrating an image forming unit and a vicinity thereof in the image forming apparatus.

FIG. 8 is a schematic view illustrating the image forming unit 70 and a vicinity thereof in the image forming apparatus 50. The image forming units 70 are provided corresponding to four colors of black (k), yellow (y), magenta (m), and cyan (c). The four image forming units 70 have the same configurations only with different colors, and a configuration will be described in reference to one of the image forming unit 70 as a representative example.

The image forming unit 70 includes a photoreceptor 77 having a drum shape, and a surface on which an electrostatic latent image is formed; a charging device 78 which is arranged along an outer periphery of the photoreceptor 77 rotationally driving in an arrow C direction, from an upstream side to a downstream side in its rotating direction; the exposing portion 76 for irradiating the photoreceptor 73 with a light beam emitted from an exposing source 79; a developing portion 81; and the cleaning device 2 as a cleaning section.

The charging device 78 is a device for evenly charging a surface of the photoreceptor 77. In the embodiment, a roller-type charging device is used, and the charging device 78 is provided in contact with an outer peripheral surface of the photoreceptor 77. Note that the charging device is not limited to the roller-type charging device, and for example a brush-type charging device, a charger-type charging device may be used.

The exposing portion 76 exposes the evenly charged surface of the photoreceptor 77 with a light beam corresponding to image information of each color corresponding to the image forming unit 70, to produce an electrostatic latent image.

The exposing source 79 irradiates the respective photoreceptors 77 with a laser beam with respect to each color based on the image information used for forming an image, to form an electrostatic latent image. The exposing source 79 includes a laser scanning unit (abbreviated as a LSU) having a laser irradiating portion, a polygon mirror, and a first and second reflecting mirrors for reflecting the laser beam with respect to each color. The laser beam emitted from the laser irradiating portion is color-separated by the polygon mirror, and is then reflected by the exposing portion as the first and second reflecting mirrors, and enters each photoreceptor 77 with respect to each color. Note that the LSU may have a configuration which uses a writing head which is formed by arranging light-emitting elements such as an electro luminescence (an EL), and a light emitting diode (a LED) to have an array structure, instead of the laser irradiating portion.

The developing portion 81 supplies the toner corresponding to the image forming unit 70 to the electrostatic latent image formed on the photoreceptor 77 to develop an image. The cleaning device 2 is arranged on an upstream side of the charging device 78 with respect to a rotating direction of the photoreceptor 77 shown by an arrow C. The cleaning device 2 includes a cleaning blade 82, and a photoreceptor waste toner transporting device 83. The cleaning blade 82 is arranged so as to contact with an outer peripheral surface of the photoreceptor 77, and scraps the residual toner which is not transferred onto the intermediate transfer body 71, from a surface of the photoreceptor 77. The photoreceptor waste toner transporting device 83 transports the toner scraped by the cleaning blade 82 to the charging communicating hole 20 of the toner recovering device 1.

The intermediate transfer body 71 is arranged above the image forming unit 70 so as to contact with the photoreceptor 77. The intermediate transfer body 71 includes a transfer belt 84, a transfer belt driving roller, a transfer belt driven roller, a transfer belt tension mechanism, and an intermediate transfer roller 85. The intermediate transfer body 71 sequentially transfers and overlays the toner images having each color formed on the photoreceptors 77 onto the transfer belt 84 to form a full-color toner image on the transfer belt 84.

The transfer belt 84 is formed by using a film-shaped member to have an endless shape. As a material of the transfer belt 84, for example, polyimide, and polycarbonate are preferably used. Further, the transfer belt 84 extends to the transfer belt driving roller and the transfer belt driven roller in a tensioned manner so that an external surface of the transfer belt 84 is in contact with an outer peripheral surface of the photoreceptor 77, and rotationally drives in a vertical scanning direction (an arrow C direction of FIG. 8) by a rotating driving force by the transfer belt driving roller while having a tension applied by the transfer belt tension mechanism.

The cleaning device 2 for removing the residual toner on the transfer belt 84 is provided on a more upstream side than the image forming unit 70 in a transporting direction of the transfer belt 84.

The toner which is attached to the transfer belt 84 due to contact with the photoreceptor 77, and/or the residual toner which is not transferred onto a recording sheet in the transfer portion 72 are removed by the cleaning device 2 in order to prevent color mixture of the toners at the next step.

Figure 9:
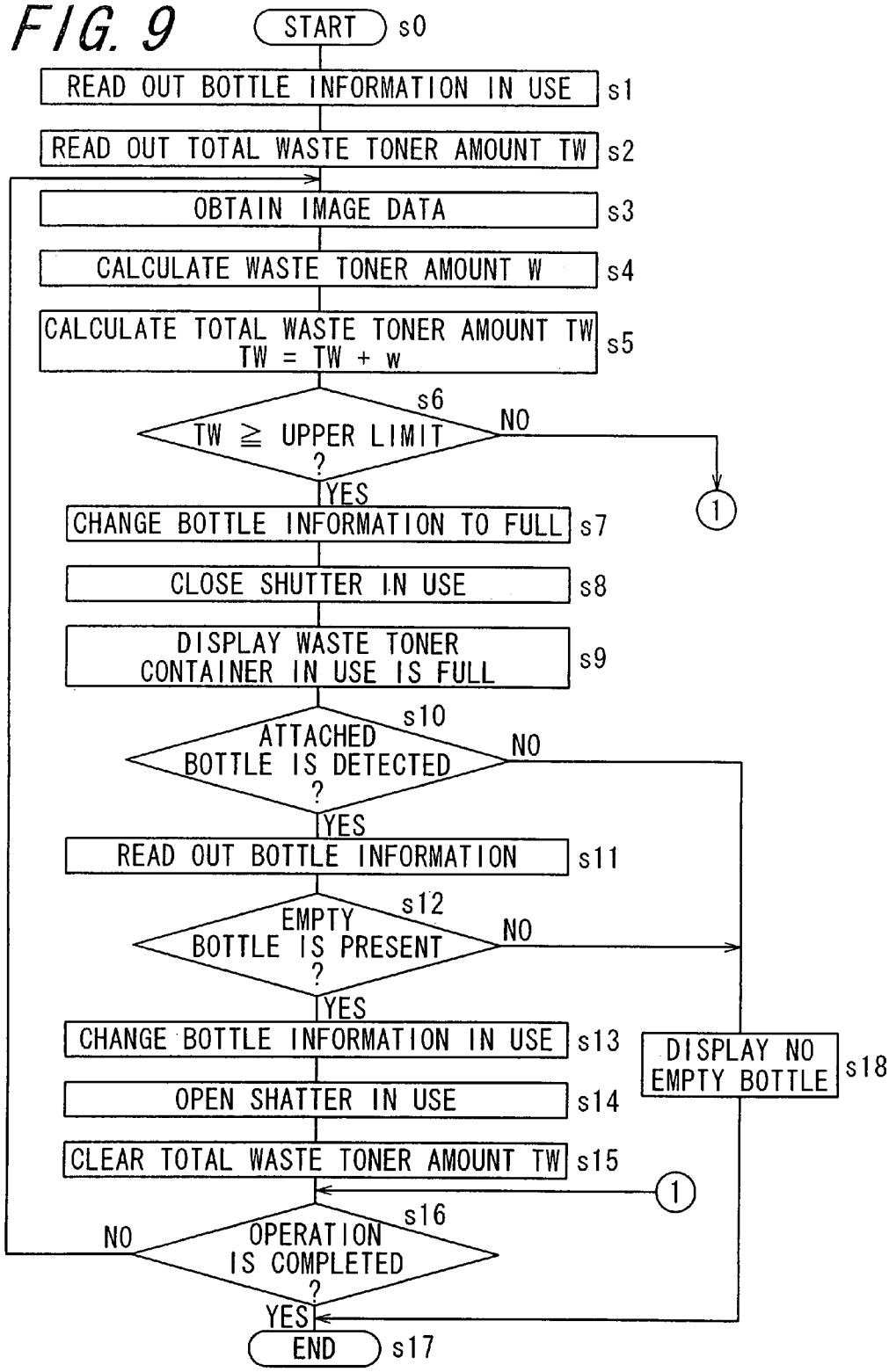
FIG. 9 is a flow chart illustrating an operation process of a control section.

FIG. 9 is a flow chart illustrating an operation process of the control section 6. When the control section 6 allows the container detecting section 8 to detect presence or absence of the waste toner container 3 to which the waste toner is discharged from the respective toner discharge portions 11 in an initial state (a reset state), and determines that only the first waste toner container 3A is arranged, the control section 6 relates bottle information of the first waste toner container 3A to bottle information thereof that the first waste toner container 3A is in use and is empty instead of full, and allows recording of total waste toner amount information representing that a total amount of the waste toner is "0".

Further, when the control section 6 allows the container detecting section 8 to detect presence or absence of the waste toner container 3 to which the waste toner is discharged from the respective toner discharge portions 11 in an initial state (a reset state), and determines that only the second waste toner container 3B is arranged, the control section 6 relates bottle information of the second waste toner container 3B to bottle information thereof that the second waste toner container 3B is in use and is empty instead of full, and allows recording of total waste toner amount information representing that a total amount of the waste toner is "0".

Further, when the control section 6 allows the container detecting section 8 to detect presence or absence of the waste toner container 3 to which the waste toner is discharged from the respective toner discharge portions 11 in an initial state (a reset state), and determines that the first waste toner container 3A and the second waste toner container 3B are arranged, the control section 6 relates bottle information of the first waste toner container 3A to bottle information thereof that the first waste toner container 3A is in use and is empty instead of full, and allows recording of total waste toner amount information representing that a total amount of the waste toner is "0", and relates bottle information of the second waste toner container 3B to bottle information thereof that the second waste toner container 3B is in use and is empty instead of full, and allows recording of total waste toner amount information representing that a total amount of the waste toner is "0".

The control section 6 allows the open-close driving section 17 to move the shutter member 16 to the opening position so that bottle information stored in the memory section 9 makes the opening 26 connected to the toner discharge portion 11 corresponding to the used waste toner container 3 open.

Here, when an instruction that enables printing based on image data is transmitted to the input section 54, the process proceeds from Step s0 to Step s1.

At Step s1, bottle information representing that the waste toner container is in use is read out from the memory section 9. The process then proceeds to Step s2.

At Step s2, the total waste toner amount information representing the stored total amount TW of the waste toner is read out from the memory section 9. The process then proceeds to Step s3.

At Step s3, image information is obtained by the input section 54. The process then proceeds to Step s4.

At Step s4, based on the image data obtained at Step s3, the toner detecting section 5 calculates an amount w of the waste toner upon printing based on the obtained image data. The process then proceeds to Step s5.

At Step s5, the total waste toner amount TW representing how much waste toner is stored in the used waste toner container 3 when printing the obtained image data is calculated. The total waste toner amount TW is obtained by adding the total waste toner amount TW read out at Step 2 to the waste toner amount w (TW=TW+w). The process then proceeds to Step s6.

At Step s6, it is determined whether the total waste toner amount TW calculated at Step s5 has reached at least a predetermined upper limit. The predetermined upper limit is recorded in the memory section 9 in advance. The predetermined upper limit is determined depending on a volume of the waste toner containers 3, and is selected to around 90% of a toner amount which can be stored in the waste toner containers 3. When it is determined that the total waste toner amount TW has reached at least the predetermined upper limit, the process proceeds to Step 7.

At Step s7, the memory section 9 is changed so that bottle information representing the used waste toner container 3 indicates the waste toner container is filled to capacity. The process then proceeds to Step s8.

At Step s8, the open-close driving section 17 is controlled so that the opening 26 for discharging the waste toner to the used waste toner container 3 is kept closed, and the locking piece driving section 56 is controlled so that the locking piece 55 which locks the used waste toner container 3 is moved from the locking position to the locking releasing position. The process then proceeds to Step s9.

At Step s9, the display section 7 displays that the waste toner container 3 is filled to capacity, corresponding to the bottle information which has been changed at Step s7 so as to represent that the waste toner container is filled to capacity. The process then proceeds to Step s10.

At Step s10, the bottle which has been attached is detected. That is, based on a detection result of the container detecting section 8, it is determined whether or not the waste toner containers 3 arranged at a predetermined position are present other than the waste toner container 3 corresponding to the bottle information which has been changed at Step s7. When it is determined that the waste toner containers 3 are present at Step s10, the process proceeds to Step s11.

At Step s11, the bottle information stored in the memory section 9 is read out. The process then proceeds to Step s12.

At Step s12, it is determined whether the empty waste toner container is present or not based on the bottle information which has been read out at Step s11. When it is determined that the empty waste toner container is present at Step s12, the process proceeds to Step s13.

At Step s13, the bottle information representing the empty waste toner container 3 is changed so that it is in use. The process then proceeds to Step s14.

At Step s14, the open-close driving section 17 is controlled so that the shutter member 16 which closes the opening 26 for discharging the waste toner to the waste toner container 3 corresponding to the bottle information which has been changed in use at Step s14 is kept opened, and the locking piece driving section 56 is controlled so that the locking piece 55 capable of locking the waste toner container 3 corresponding to the bottle information which has been changed in use at Step s14 is moved from the locking releasing position to the locking position. The process then proceeds to Step s15.

At step s15, information representing the total waste toner amount TW stored in the memory section 9 is erased. That is, information representing that the total waste toner amount is "0" is recorded in the memory section 9. The process then proceeds to Step s16.

At Step s16, it is determined whether all required print jobs are completed, and operations are finished or not. When it is determined that operations are finished at Step s16, the process proceeds to Step s17 to finish processing operations.

At Step s6 described above, when it is determined that the total waste toner amount TW does not reach at least the predetermined upper limit, the process proceeds to Step s16.

At Step s10 described above, when it is determined that the waste toner containers 3 are present, the process proceeds to Step s18.

At Step s18, the display section 7 displays information representing that the empty waste toner container 3 is absence. Here, the display section 7 displays characters, "No empty bottle". The process then proceeds to Step s17.

Further, at Step s16, when it is determined that operations are not finished, the process proceeds to Step s3.

As described above, in the toner recovering device 1 according to the embodiment, the toner transporting section 4 is provided with the plurality of toner discharge portions 11, and selectively discharges the waste toner from any one of the plurality of toner discharge portions 11 to store the waste toner to the waste toner container 3 to which the waste toner discharged from the selected toner discharge portion 11 is to be stored, and thereby it is possible to exchange the waste toner container 3 corresponding to the toner discharge portion 11 which is not used for discharging the waste toner. Therefore, it is possible to exchange the waste toner container 3 without stopping an image forming operation in the image forming apparatus 50 which is provided with the cleaning device 2. Moreover, the waste toner is discharged from any of the plurality of toner discharge portions 11 to the waste toner containers 3 without temporarily storing the waste toner while transporting the waste toner to the waste toner containers 3. Accordingly, it is possible to prevent the waste toner from being solidified to produce a jam during its transportation, allowing a smooth recovering of the waste toner. Therefore, convenience can be improved.

Further, even when the waste toner container 3 is provided corresponding to each of the plurality of toner discharge portions 11, the control section 6 controls the toner transporting section 4 to discharge the waste toner from the toner discharge portion 11 corresponding to the waste toner container 3 which is available for storing the waste toner, based on a storing state of the waste toner which is detected by the toner detecting section 5, thereby preventing the waste toner from being further discharged to the waste toner container which is not available for storing the waste toner, for example when the waste toner containers 3 are filled to capacity.

Further, when the plurality of waste toner containers 3 which are available for storing the waste toner are provided, the waste toner is discharged from the toner discharge portion 11 corresponding to one of the waste toner containers 3 which is available for storing the waste toner. When the control section 6 determines that the waste toner container 3 to which the waste toner is discharged has been filled to capacity, the control section 6 controls the toner transporting section 4 so as to discharge the waste toner from the toner discharge portion 11 corresponding to the remaining one of the plurality of waste toner containers 3. Accordingly, when the one waste toner container 3 is filled with the waste toner to capacity, the toner transporting section 4 can discharge the waste toner by switching the waste toner discharge portion 11 so as to discharge the waste toner to the waste toner container 3 which is available for storing the waste toner. Accordingly, even though the one waste toner container 3 is filled to capacity, the waste toner can be transported to the waste toner container 3 which is available for storing the waste toner, for example, the empty waste toner container 3. Therefore, even though the one waste toner container 3 is filled to capacity, it is possible to continue an image forming operation in the image forming apparatus 50 without the need for stopping the image forming operation in the image forming apparatus 50 which is provided with the cleaning device 2.

Moreover, when the control section 6 determines that the at least one waste toner container 3 is filled to capacity, based on a detection result of the toner detecting section 5, the control section 6 allows the display section 7 to display predetermined alarm information, thereby encouraging a user to exchange the waste toner container 3 and to smoothly operate the toner recovering device 1.

Further, based on a result obtained using the container detecting section 8 by detecting presence or absence of the waste toner container 3 to which the waste toner discharged from the respective toner discharge portions 11 is to be stored, the control section 6 controls the toner transporting section 4 so as to discharge the toner only from the toner discharge portion 11 which is available for discharging the waste toner to the waste toner container 3. Accordingly, it is possible to prevent the waste toner from being discharged from the toner discharge portion 11 in which the corresponding waste toner container 3 is not provided.

Further, the shutter member 16 is moved by the open-close driving section 17 to open or close the opening 16 of the agitating tank 19 on which the openings 26 individually communicating with the plurality of toner discharge portions 11 are formed. Accordingly, it is possible to selectively discharge the waste toner from any one of the toner discharge portions 11. When the shutter member 16 for opening or closing the opening 26 communicating with one of the toner discharge portion is kept opened, the shutter member 16 for opening or closing the opening 26 communicating with the remaining toner discharge portion is kept closed. Therefore, when the shutter member 16 is kept closed, the waste toner container is exchanged, thereby preventing the waste toner from being undesirably discharged, and preventing contamination of the waste toner in the image forming apparatus 50 provided with the toner recovering device 1.

Further, the toner transporting section 4 includes the agitating portion for agitating the waste toner to agitate the waste toner having a tendency to be solidified. Accordingly, it is possible to prevent the waste toner from being solidified, and to certainly prevent the waste toner from being solidified and producing a jam during its transportation. Therefore, it is possible to smoothly recover the waste toner, preventing occurrence of a device failure caused by solidification of the waste toner to produce high reliability.

Further, the waste toner which has been transported to the agitating tank 19 is agitated in association with rotation of the agitating member 14. In the agitating member 14, a portion in contact with the internal wall surface 24 is formed using the contacting member 35 having flexibility and elasticity, and when the agitating member 14 rotates, the contacting member having flexibility and elasticity slides in contact with the internal wall surface 24. Accordingly, the waste toner is prevented from being firmly fixed to a portion of the internal wall surface 24 in contact with the contacting member 35 having flexibility and elasticity. Moreover, even though the waste toner is fixed to this portion, deformation of the contacting member 35 prevents rotation of the agitating member from being hampered by the waste toner fixed to the agitating member, and thus prevents a failure of the agitating member 14, thereby achieving a stable agitation by the agitating portion.

Further, by providing the toner recovering device 1 in the image forming apparatus 50, the waste toner containers 3 can be exchanged without stopping an image forming operation in the image forming section 51, preventing an image forming operation in the image forming section 51 from being hampered by a toner recovering device to realize the image forming apparatus with which convenience is improved.

Further, when the waste toner containers 3 are filled to capacity, an image forming operation by the image forming section 51 is stopped, thereby preventing the waste toner from being accumulated up to the toner transporting section, and preventing a failure of the waste toner recovering device 1.

Further, an amount of the toner which is stored in the waste toner containers 3 is detected based on image information, and thereby it is not necessary to provide a sensor for measuring the amount of the waste toner in the waste toner containers 3, allowing a simple configuration of the apparatus. Moreover, the amount of the waste toner which is stored in the waste toner containers 3 can be continuously detected, allowing fine detection of a storing state of the waste toner in the waste toner containers 3. Accordingly, a printable sheet number to be printed until the waste toner containers 3 is filled to capacity is obtained. Therefore, there can be provided a configuration that, for example, when a print is determined to be difficult by determining whether it is possible to print until a last page when a print request is received, an alarm is given to a user on the display section 7.

Further, the waste toner container 3 to which the waste toner is transported by the toner transporting section 4 during an image forming operation by the image forming section 51 is locked, and the lock of the waste toner container 3 to which the waste toner is not transported is unlocked. Accordingly, it is possible to prevent the waste toner container 3 to which the toner transporting section 4 discharges the waste toner from being undesirably removed. In addition, it is possible to remove and exchange the waste toner container 3 to which the toner transporting section 4 does not discharge the waste toner, even during an image forming operation by the image forming section 51.

Further, the toner recovering device according to another embodiment of the invention may be configured so that the toner detecting section 5 includes a toner remaining amount sensors which are provided in the waste toner containers 3, respectively. The toner remaining amount sensor is realized, for example, by a pressure oscillation type sensor, and detects presence of fine particles by fine particle's contact with a detecting surface thereof. The waste toner containers 3 have a cylindrical shape having a bottom, and an opening is formed on an upper portion thereof. The toner remaining amount sensor is provided in an end near to the opening of the waste toner containers 3. When a stored amount of the waste toner stored in the waste toner containers 3 is increased to reach a full capacity, the toner remaining amount sensor can detect a storing state of the waste toner, here, whether the waste toner containers are filled to capacity or not, by waste toner's contact with a detecting surface of the toner remaining amount sensor.

As described above, an operation process when using the toner remaining amount sensor corresponds to a flow chart in which operations from Step s2 to Step s6, and of Step s15 are omitted in the flow chart of FIG. 9 described above. According to the toner recovering device of the embodiment, an effect similar to that of the above-described embodiment can be achieved. Moreover, it is not necessary to calculate a waste toner amount based on image information, thereby allowing a decrease in a processing load of a microcomputer.

Further, in the toner recovering apparatus according to another embodiment of the invention, the toner detecting section 5 may be realized by a weight sensor for detecting a weight of the respective waste toner containers 3. Also in this case, an effect similar to a case of using the toner remaining amount sensor can be achieved.

Further, in still another embodiment of the invention, there may be provided a configuration in which the shutter member 16 is configured so that the arm portion 45 is formed short and is not fixed to a shaft, and while the shutter member 16 is being energized by a spring member around the axis line L1 in one direction, the shutter member 16 is pulled to the other direction using an electromagnetic valve, a plunger, or the like, and thereby the shutter member 16 is moved throughout from the opening position to the closing position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. A developer recovering device for transporting to waste developer containers a waste developer which has been recovered by a cleaning device for removing a residual developer on an image bearing member after a developer image has been transferred onto a recording material, comprising:

a developer transporting section having a plurality of developer discharge portions, for transporting the waste developer from the cleaning device so as to be selectively discharged from any one of the developer discharge portions;

a developer detecting section individually corresponding to the plurality of developer discharge portions, for detecting a storing state of the waste developer in the waste developer containers to which the waste developer discharged from the developer discharge portion is to be stored; and a control section for controlling the developer transporting section so as to discharge the waste developer from the developer discharge portion corresponding to a waste developer container of the waste developer containers, which is available for storing the waste developer, based on a detection result of the developer detecting section, wherein the developer transporting section comprises:

an agitating tank that receives waste developer from the cleaning device, wherein first and second openings are formed in the agitating tank; and an agitating member that is rotatably mounted in the agitating tank, and that is selectively rotated in first and second rotational directions in the agitating tank, wherein when the agitating member rotates in a first rotational direction, waste developer received from the cleaning device is conveyed by the agitating member directly to the first opening, and wherein when the agitating member is rotated in the second rotational direction, waste developer received from the cleaning device is conveyed by the agitating member directly to the second opening, wherein the agitating member comprises a shaft that is rotationally mounted in the agitating tank, and only a plurality of substantially flat agitating blades that extend radially outward from the shaft and that have a planar surface that extends parallel to the shaft.

2. The developer recovering device of claim 1, wherein, when the control section determines that a first one of the waste developer containers has been filled to capacity, based on a detection result of the developer detecting section, the developer transporting section is controlled so as to discharge the waste developer from the developer discharge portion to a second one of the plurality of waste developer containers which is not yet filled to capacity.

3. The developer recovering device of claim 1, further comprising a display section, wherein the control section allows the display section to display predetermined alarm information, when it is determined that the at least one waste developer container has been filled to capacity, based on a detection result of the developer detecting section.

4. The developer recovering device of claim 1, further comprising a container detecting section for detecting presence or absence of the available waste developer container in which the waste developer discharged from the respective developer discharge portions is to be stored, wherein the control section controls the developer transporting section so as to discharge the developer only from the developer discharge portion which is available for discharging the waste developer to the waste developer container, based on a detection result of the container detecting section.

5. An image forming apparatus comprising:

an image forming section including an image bearing member for bearing a developer image and a cleaning section for removing a residual developer on the image bearing member, for allowing the image bearing section to bear the developer image based on image information, transferring the developer image onto a recording material, and fixing the transferred developer image onto the recording material; and the developer recovering apparatus of claim 1 for recovering the developer which has been removed by the cleaning member.

6. The image forming apparatus of claim 5, wherein when the control section determines that all of the waste developer containers which are available for having the developer transported by the developer transporting section have been filled to capacity, based on a detection result of the developer detecting section, the control section allows the image forming section to stop an image forming operation.

7. The image forming apparatus of claim 5, wherein the developer detecting section detects an amount of the developer which is stored in the waste developer containers, based on the image information.

8. The image forming apparatus of claim 7, wherein the developer detecting section calculates an amount of the developer which is stored in the waste developer containers based on input signals values for individual pixels of the image information.

9. The image forming apparatus of claim 8, wherein the amount of the developer which is stored in the waste developer containers is also calculated based on weighting coefficients for individual pixels of the image information, the weighting coefficients being based upon grayscale values for the individual pixels.

10. The image forming apparatus of claim 5, further comprising a locking section capable of individually engaging and locking the waste developer containers at a position capable of storing the waste developer discharged from the respective developer discharge portions, wherein the locking section locks the available waste developer container to which the waste developer is to be transported by the developer transporting section during an image forming operation by the image forming section, and unlocks the lock of the waste developer container to which the waste developer is not transported.

11. The developer recovering device of claim 1, wherein each agitating blade further comprises a flexible contact member that is provided at the end of the agitating blade, the flexible contact members contacting and sliding along an inner wall of the agitating tank when the agitating member rotates within the agitating tank.

12. The developer recovering device of claim 1, wherein the agitating tank is cylindrical, wherein the first and second openings in the agitating tank are formed on a cylindrical sidewall of the agitating tank, and wherein the agitating tank further comprises first and second shutters that corresponding to the first and second openings in the agitating tank, respectively, each of the first and second shutters being selectively movable between an open position in which the shutter opens the corresponding opening in the agitating tank and a closed position in which the shutter closes the corresponding opening in the agitating tank.

13. The developer recovering device of claim 12, wherein each of the first and second shutters comprises an arcuate shaped shutter body that has a shape corresponding to the cylindrical wall of the agitating tank in which the first and second openings are formed.

14. An image forming apparatus comprising:

an image forming section that forms a developer image on an image bearing member based on image data and a cleaning section for removing a residual developer on the image bearing member;

a developer transporting section that transports waste developer from the cleaning section to selected ones of a plurality of waste developer containers, wherein the developer transporting section comprises:

an agitating tank that receives waste developer from the cleaning section, wherein first and second openings are formed in the agitating tank, and an agitating member that is rotatably mounted in the agitating tank and that rotates to convey waste developer in the agitating tank to the first and second openings, wherein the agitating member comprises a shaft that is rotationally mounted in the agitating tank, and only a plurality of substantially flat agitating blades that extend radially outward from the shaft and that have a planar surface that extends parallel to the shaft; and a waste developer calculating section that calculates an amount of waste developer stored in each of the waste developer containers based on input signals values for individual pixels of the image data.

15. The image forming apparatus of claim 14, wherein the waste developer calculating section also calculates the amount of waste developer in each of the waste developer containers based on weighting coefficients for individual pixels of the image data, the weighting coefficients being based upon grayscale values for the individual pixels.

16. The image forming apparatus of claim 14, wherein the agitating tank is cylindrical, wherein the first and second openings in the agitating tank are formed on a cylindrical sidewall of the agitating tank, and wherein the agitating tank further comprises first and second shutters corresponding to the first and second openings in the agitating tank, respectively, each of the first and second shutters being selectively movable between an open position in which the shutter opens the corresponding opening in the agitating tank and a closed position in which the shutter closes the corresponding opening in the agitating tank.

17. The image forming apparatus of claim 16, wherein each of the first and second shutters comprises an arcuate shaped shutter body that has a shape corresponding to the cylindrical wall of the agitating tank in which the first and second opening are formed.

* * * * *